United States Patent [19]

Kuznetzoff

[11] Patent Number: 4,534,744

[45] Date of Patent: Aug. 13, 1985

[54] DISPLAY PANEL AND METHOD OF MAKING IT

[75] Inventor: Philip Kuznetzoff, Bridgewater, N.J.

[73] Assignee: Burroughs Corporation, Detroit, Mich.

[21] Appl. No.: 490,495

[22] Filed: May 2, 1983

[51] Int. Cl.[3] ..... H01J 9/00

[52] U.S. Cl. ..... 445/47; 445/44; 445/11; 445/12; 445/14

[58] Field of Search ..... 445/11, 12, 13, 14, 445/44, 47, 37

[56] References Cited

U.S. PATENT DOCUMENTS

| | | | |
|---|---|---|---|
| 2,933,648 | 4/1960 | Bentley | 445/25 |
| 3,661,581 | 5/1972 | Feldstein | 445/47 |
| 3,663,997 | 5/1972 | Kuznetzoff | 445/47 |
| 3,715,785 | 2/1973 | Brown et al. | 445/24 |
| 3,743,879 | 7/1973 | Kupsky | 445/24 |
| 4,195,892 | 4/1980 | Riley et al. | 445/24 |
| 4,341,591 | 7/1982 | Tamutus | 445/37 |
| 4,386,348 | 5/1983 | Holz et al. | 340/714 |

*Primary Examiner*—Nicholas P. Godici
*Assistant Examiner*—Kurt Rowan
*Attorney, Agent, or Firm*—Kevin R. Peterson; Edmund M. Chung; Robert A. Green

[57] ABSTRACT

The method of making a display panel 10 comprising forming an assembly of a glass base plate having a set of longitudinal first slots in which anode electrodes are secured and having an array of cathode electrodes seated on the top surface of the base plate and oriented transverse to the anodes. An apertured electrode plate is disposed adjacent to the base plate and its electrodes, and a face plate assembly is prepared by providing a glass plate and forming on one surface, in order, a large-area electrode and one or more insulating layers, after which an apertured insulating layer is formed thereon by a photo-etching process. The face plate assembly carrying the apertured insulating layer is assembled with the other parts of the panel, and the panel is processed to completion.

3 Claims, 4 Drawing Figures

DISPLAY PANEL AND METHOD OF MAKING IT

BACKGROUND OF THE INVENTION

A recently invented display panel which comprises a dot matrix display having memory is relatively complex and includes several support plates, insulating layers, and electrode arrays which must be prepared and assembled accurately. This panel is described and claimed in copending application Ser. No. 051,313, filed June 22, 1979, of George E. Holz and James A. Ogle, now U.S. Pat. No. 4,386,348.

The present invention relates to improvements in the panel which simplify its preparation.

DESCRIPTION OF THE INVENTION

The present invention is used to manufacture a display panel 10 of the type described and claimed in copending application of George E. Holz and James A. Ogle, Ser. No. 051,313, filed June 22, 1979. This application is incorporated herein by reference, along with the patents and publications cited therein. This application describes a dot matrix memory display panel including a D.C. scan/address portion and an A.C. display portion.

Figure 1:
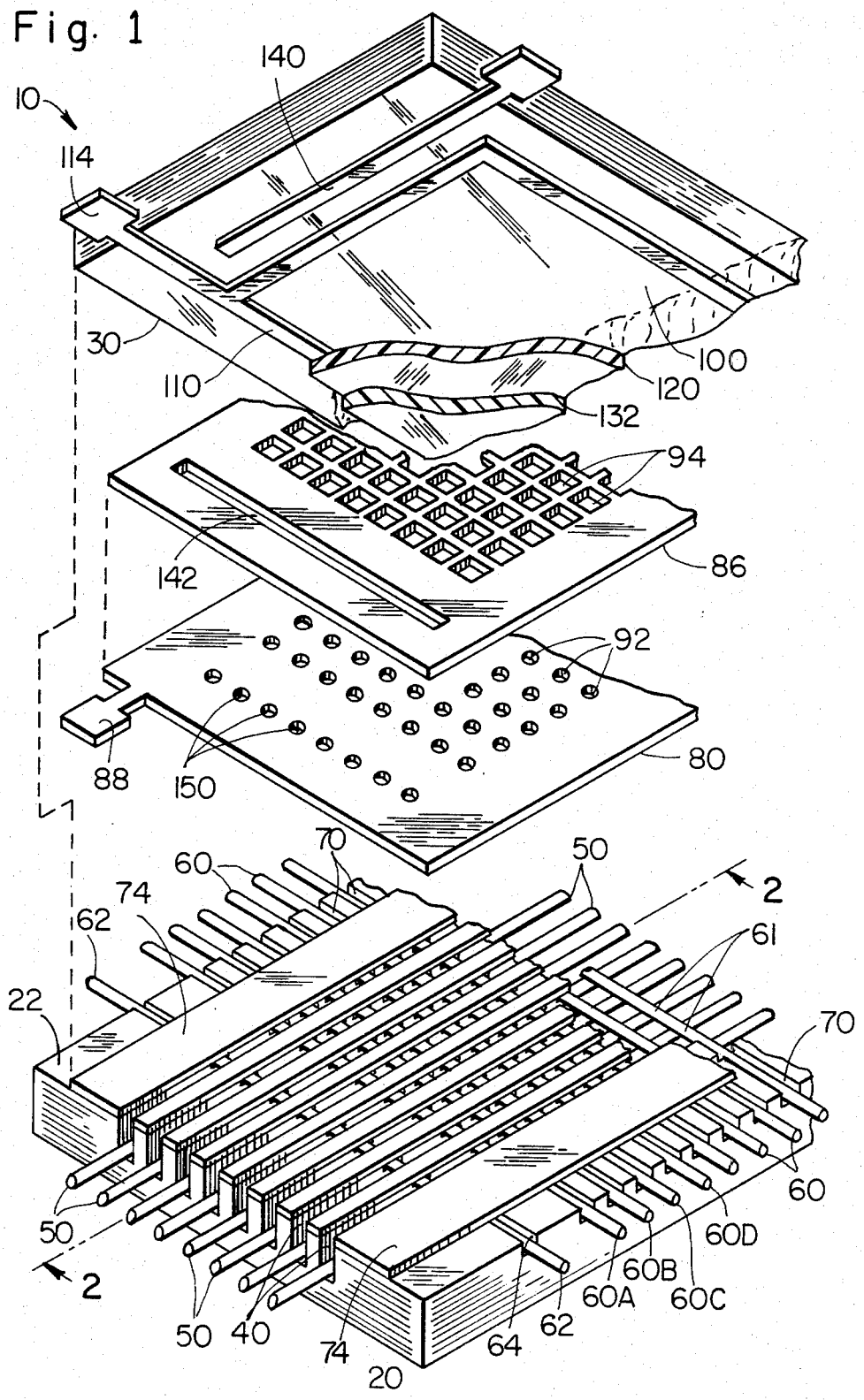
FIG. 1 is a perspective exploded view of a display panel embodying the invention.
Figure 2:
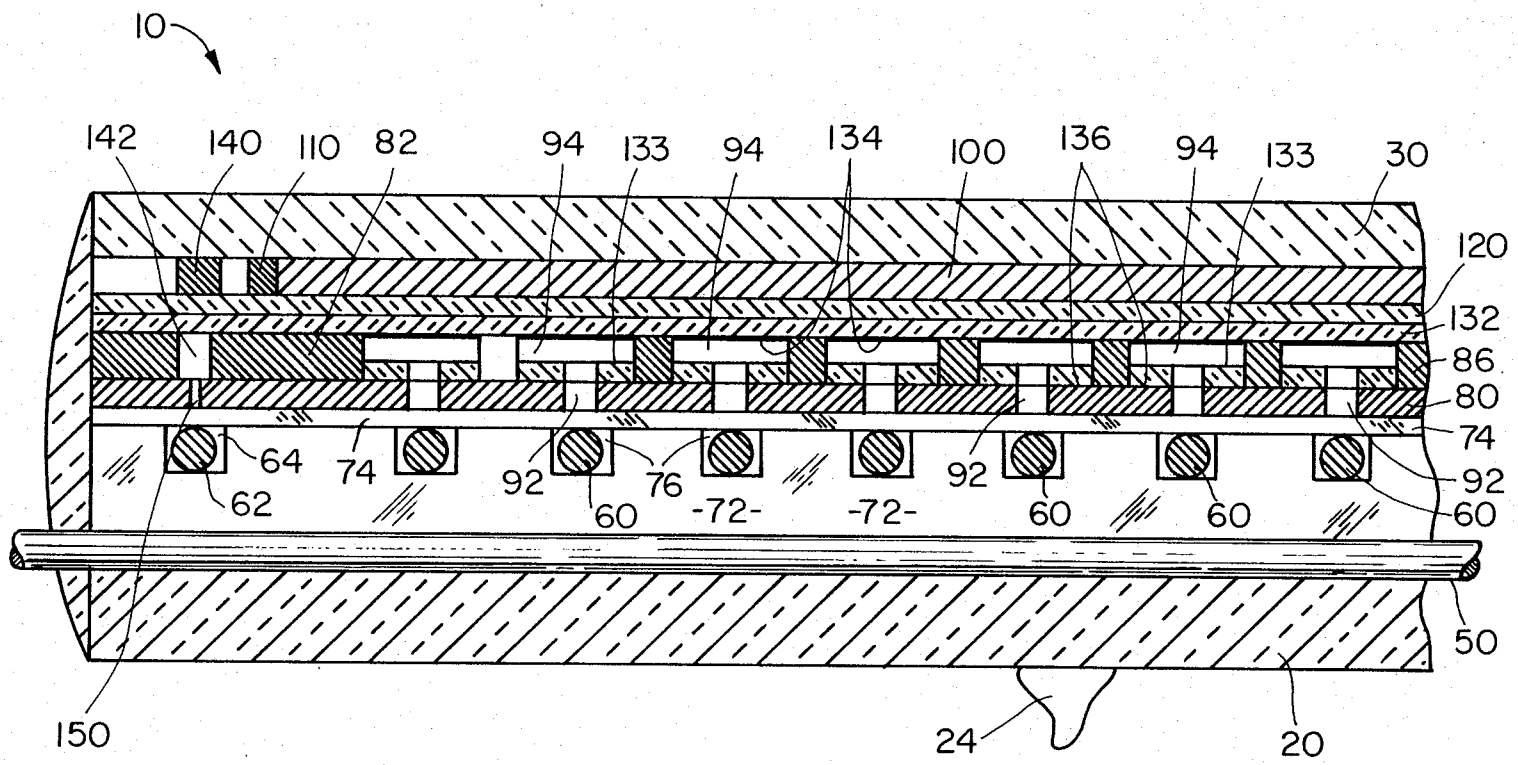
FIG. 2 is a sectional view through the panel of FIG. 1 along lines 2—2, with the panel shown assembled.

The display panel 10 includes a gas filled envelope made up of an insulating base plate or substrate 20 and a glass face plate 30, which are hermetically sealed together, as illustrated in FIG. 2, along a closed periphery which surrounds the operating inner portion of the panel and the various gas cells provided therein. The base plate has a top surface 22, in which a plurality of relatively deep parallel, longitudinal slots 40 are formed and in each of which a scan/address anode electrode, for example a wire 50, is seated and secured.

A plurality of scan cathode electrodes, in the form of wires or strips, are seated on the top surface of the base plate or in shallow slots 70 therein. The scan cathodes 60 are disposed transverse to the scan anodes 50, and each crossing of a scan cathode 60 and a scan anode 40 defines a scanning cell 72 (FIG. 2). It can be seen that the scanning cells are arrayed in rows and columns. More specifically, the cathode portions 61, the underlying portions of anodes 50, and the intermediate gaseous regions define the scanning cells.

The scan cathodes 60A, B, C, etc., form a series of cathodes which can be energized serially in a scanning cycle, with cathode 60A being the first cathode energized in the scanning cycle.

A reset cathode electrode 62 is disposed in a slot 64 in the top surface of the base plate adjacent to the first scan cathode 60A, so that, when it is energized, it provides excited particles for cathode 60A at the beginning of a scanning cycle to be described. Where the reset cathode crosses each scan anode, a reset cell is formed, and the crossing of all of the scan anodes by the reset cathode provides a column of reset cells. These reset cells are turned on or energized at the beginning of each scanning cycle, and they expedite the turn on of the first column of scanning cells associated with the first cathode 60A.

The panel 10 includes a suitable keep alive arrangement, one form of which is described below and in U. S. Pat. No. 4,329,616 of George E. Holz and James A. Ogle, which is incorporated herein by reference.

In the panel 10, a spacer means comprising strips 74 of insulating material, such as glass, are provided on the top surface of the insulating plate 20 and on cathodes 60 and 62 so that the cathodes are spaced uniformly from an electrode plate 80 disposed above them, as described below. The strips 74 are disposed across the cathodes 60 which are thus separated into discrete operating portions.

The portions of the panel described up to this point comprise the base plate assembly. This is the D.C. portion and the scanning and addressing portion of the panel.

Adjacent to the base plate assembly is the second portion of the panel which is a quasi A.C. assembly; that is, it includes A.C. and D.C. features. This portion of the panel includes an electrode in the form of a thin metal plate 80 (known as the priming plate) having an array of rows and columns of relatively small apertures 92, each overlying one of the scanning cells. The plate 80 is positioned close to cathodes 60 and may be seated on insulating sheet 74. Electrode plate 80 includes a terminal 88 for making electrical connection thereto.

Adjacent to plate 80, and preferably in contact with the upper surface thereof, is an apertured plate or layer 86 (known as the glow isolator) having rows and columns of apertures 94 which are considerably larger than apertures 92. The apertures 94 comprise the display cells of panel 10. The sheet 86 may be of insulating material, as shown in FIG. 2, or it may be of metal, and, if it is of metal, the plates 80 and 86 may be made in one piece.

The quasi A.C. assembly also includes a face plate assembly which includes a single large-area transparent conductive electrode 100 on the inner surface of the plate 30. A narrow conductor 110, which outlines and reinforces the electrode layer 100 in conductive contact, serves to increase its conductivity, if necessary. The conductor 110 includes a suitable tab 114, to which external connection can be made. The large area electrode 100 is of sufficient area to overlie the entire array of display cells 94 in plate 86. An insulating coating 120 of glass or the like covers electrode 100.

Under some circumstances, it is desirable to coat the glass layer 120 with a low work function refractory layer 132 of magnesium oxide, thorium oxide, or the like.

In panel 10, the apertures 94 in plate 86 comprise display cells, and, as can be seen in FIG. 2, each display cell has one end wall 134 formed by a portion of insulating layer 132, and an opposite end wall 136 formed by a portion of the top surface of plate 80. To provide cell uniformity and to minimize sputtering, a coating of the material of layer 132 should also be provided on the base or lower wall 136 of each display cell 94, such as the layer 133 shown in FIG. 2.

Panel 10 has a keep-alive arrangement, referred to above, which includes an A.C. electrode 140 in the form of a linear conductive film or layer of opaque metal, such as silver provided on the inner surface of the face plate 30 adjacent to one edge of the transparent conductive electrode 100. The A.C. keep-alive electrode 140 is positioned so that it is in optimum operative relation with the column of reset cells and reset cathode 62, to which it supplies excited particles. The A.C. keep-alive electrode 140 is covered by the insulating layers 120 and 132. The plate 86 is provided with a slot 142, and plate 80 is provided with a column of holes 150, the slot 142 overlying and being aligned with the column of holes 150, and both lie beneath and are aligned with the A.C. electrode 140. The slot 142 in the plate 86 is narrower than the opaque A.C. electrode 140 so that a viewer, looking through face plate 30, cannot see any glow which is present in slot 142 and holes 150. Electrode 140 operates with plate 80 to produce glow discharge between them and produce excited particles in slot 142 and holes 150. These excited particles are available to the reset cathode 62 and assist the firing of the column of reset cells.

The gas filling in panel 10 is preferably a Penning gas mixture of, for example, neon and a small percentage of xenon, at a pressure of about 400 Torr. When the panel has been constructed and evacuated, the gas filling is introduced through a tubulation 24 secured to base plate 20 (FIG. 2), or a non-tubulated construction can be employed.

In making the panel 10, the base plate assembly, including glass base plate 20, anodes 50, cathodes 60, and insulating strips 74, are prepared in any suitable manner, for example, as described in the herein incorporated U.S. Pat. No. 4,352,050 of Nicholas C. Andreadakis. Plate 80 is a plate of any suitable metal in which the holes 92 and 150 are formed by laser drilling or in any other suitable manner. The face plate and the electrode 100 and ring 110 and glass layer 120 and magnesium oxide layer 132 are prepared in any well known manner.

Figure 3:
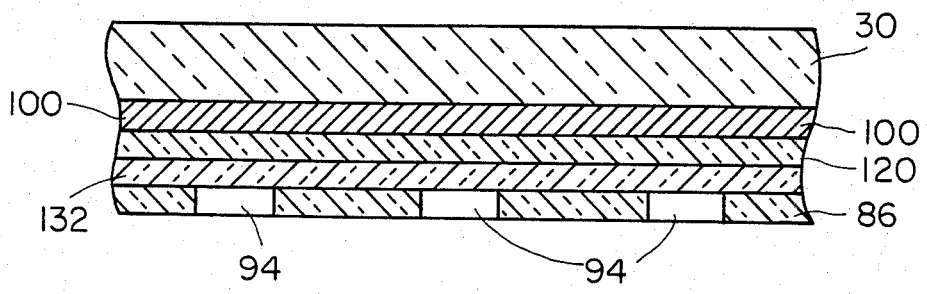
FIG. 3 is a sectional view of a portion of the face plate of the panel of FIG. 1 at one stage in the manufacture of the face plate assembly.
Figure 4:
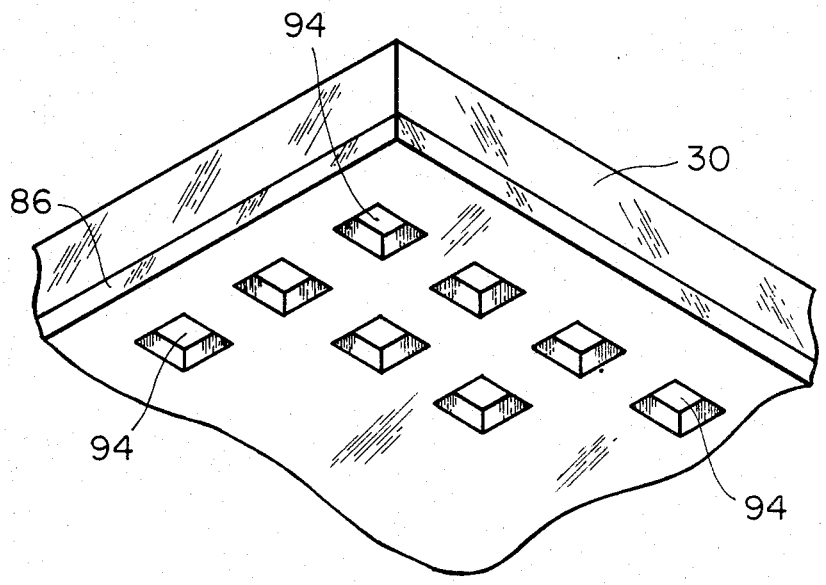
FIG. 4 is a perspective view of the assembly of FIG. 3 at a later stage in its preparation and ready for assembly with other parts of the display panel.

According to the invention, referring to FIGS. 3 and 4, the glow isolator plate 86 is prepared on the layer 132 on the face plate. The invention can be carried out with several materials and appropriate process steps. For example, one material is Fotoform®, a Corning product which is available in the form of a thin plate which is secured to the lower surface of the face plate and then is exposed through a suitable mask and developed with heat to form a pattern of crystallized regions in the plate. When the plate is then contacted with a solvent, such as dilute hydrofluoric acid, the crystallized regions are removed, and this leaves the desired glow isolator plate 86 on the face plate.

Another usable material is Fodel®, a DuPont product, which is a photopolymer available in the form of a paste containing certain fillers, in this case, glass fillers. The paste material is spread on the lower surface of the face plate to form a layer which is exposed and developed and processed with a spray of 1, 1, 1 trichloroethane to remove the unexposed portions and this leaves apertured plate 86.

Another usable material is also a DuPont product known as Riston®. This is a photopolymer which comes in sheets, and a length is secured to the lower surface of the base plate. The applied layer is then exposed and developed and etched in 1, 1, 1 trichloroethane to leave an array of islands of Riston in a pattern which is the reverse of the pattern of apertures 94 in the glow isolator plate; that is, there are islands of Riston where the apertures 94 are in the completed glow isolator. A layer of glass or ceramic is then applied to the Riston layer, and the remains of the Riston layer are etched out with the same etchant to leave the desired apertured glow isolator plate 86.

After this face plate assembly has been prepared, all of the panel parts are then assembled and processed to completion.

What is claimed is:

1. The method of making a display panel comprising the steps of forming a plurality of relatively deep parallel, longitudinal first slots in a glass base plate having a top surface, securing an anode electrode in each of said first slots, providing a plurality of cathode electrodes adjacent to the top surface of said base plate oriented generally transverse to said anode electrodes, said cathode electrodes crossing said anode wires and forming a first glow cell at each crossing, said first glow cells being disposed in rows and columns in a first layer, placing means comprising strips of insulating material on said base plate overlying said cathodes, mounting an electrode plate on said base plate, said electrode plate having an array of small holes, each of which overlies one of said first glow cells, preparing a face plate assembly made up of a glass plate having two surfaces, on one of which is formed a large-area transparent electrode covered by a thin layer of glass which is covered by a second insulating layer and a third insulating layer having an array of apertures therein, mounting said face plate assembly on said electrode plate with the apertures in said third insulating layer aligned with the small holes in said electrode plate, and hermetically sealing together all of said parts to form the completed panel and filling the panel with an ionizable gas, said third insulating layer in said face plate assembly being prepared by forming on the bottom surface of a glass plate, in order, first a large-area transparent electrode, second a layer of glass, and third a layer of insulating material, providing a layer of photosensitive material on said third layer, exposing said layer in a pattern and developing said pattern in said layer to render portions thereof resistant to removal, removing portions of said layer to leave an apertured insulating plate which is the reverse of said third insulating layer and has solid material where said third insulating layer has apertures, providing areas of insulating material in the apertures in said insulating plate, and removing all of apertured insulating plate to leave said areas of insulating material which comprise said third layer of insulating material.

2. The method defined in claim 1 wherein the material provided in said apertures is a glass.

3. The method of making a display panel comprising the steps of forming a plurality of relatively deep parallel, longitudinal first slots in a glass base plate having a top surface, securing an anode electrode in each of said first slots, providing a plurality of cathode electrodes adjacent to the top surface of said base plate oriented generally transverse to said anode electrodes, said cathode electrodes crossing said anode wires and forming a first glow cell at each crossing, said first glow cells being disposed in rows and columns in a first layer, placing means comprising strips of insulating material on said base plate overlying said cathodes, mounting an electrode plate on said base plate, said electrode plate having an array of small holes, each of which overlies one of said first glow cells, preparing a face plate assembly made up of a glass plate having two surfaces, on one of which is formed a large-area transparent electrode covered by a thin layer of glass which is covered by a second insulating layer and a third insulating layer having an array of apertures therein, mounting said face plate assembly on said electrode plate with the apertures in said third insulating layer aligned with the small holes in said electrode plate, and hermetically sealing together all of said parts to form the completed panel and filling the panel with an ionizable gas, said third insulating layer in said face plate assembly being prepared by forming on the bottom surface of a glass plate, in order, first a large-area transparent electrode, second a layer of glass, and third a layer of insulating material, providing a layer of photosensitive material on said third layer, forming an array of apertures in said layer of photosensitive material, filling said apertures with glass, and removing said layer of photosensitive material to leave an array of spaced-apart glass bodies which define apertures which are the display cells in said third layer.

* * * * *